US011178952B2

(12) United States Patent
Abadilla

(10) Patent No.: US 11,178,952 B2
(45) **Date of Patent: *Nov. 23, 2021**

(54) APPLICATOR

(71) Applicant: Arvin Abadilla, Carlsbad, CA (US)

(72) Inventor: Arvin Abadilla, Carlsbad, CA (US)

( * ) Notice: Subject to any disclaimer, the term of this patent is extended or adjusted under 35 U.S.C. 154(b) by 145 days.

This patent is subject to a terminal disclaimer.

(21) Appl. No.: 16/691,911

(22) Filed: Nov. 22, 2019

(65) Prior Publication Data

US 2020/0138165 A1 May 7, 2020

Related U.S. Application Data

(63) Continuation of application No. 16/177,783, filed on Nov. 1, 2018, now Pat. No. 10,561,220.

(51) Int. Cl.

| | |
|---|---|
| ***A46B 5/02*** | (2006.01) |
| ***A45D 34/04*** | (2006.01) |
| ***B65D 35/38*** | (2006.01) |
| ***A45D 40/26*** | (2006.01) |

(52) U.S. Cl.

CPC ..... *A45D 34/04* (2013.01); *A45D 40/26* (2013.01); *B65D 35/38* (2013.01); *A45D 2200/054* (2013.01); *A45D 2200/10* (2013.01)

(58) Field of Classification Search

CPC ..... A45D 34/04; B65D 35/36

USPC ..... 401/9–11, 183

See application file for complete search history.

(56) References Cited

U.S. PATENT DOCUMENTS

| | | | | |
|---|---|---|---|---|
| 2,888,695 | A * | 6/1959 | Anderson | A45D 40/26 401/266 |
| 6,050,274 | A * | 4/2000 | Gelardi | A45D 40/26 132/311 |
| 2004/0168743 | A1* | 9/2004 | Garwood | A45D 34/04 141/266 |
| 2009/0317164 | A1* | 12/2009 | Fukumoto | B65D 47/42 401/6 |

* cited by examiner

*Primary Examiner* — Jennifer C Chiang
(74) *Attorney, Agent, or Firm* — Eric Hanscom

(57) ABSTRACT

An applicator used for evenly spreading a cream from a tube to which the applicator is attached. The applicator has a base unit that fits over the opening in the tube of cream and directs the cream through a hole in applicator unit, which is the upper part of the invention. The applicator unit has a spreader, which evenly distributes the cream onto a non-planar surface. The spreader is made from flexible, resilient material, and has a tip and wings that emanate out from the hole in the top of the spreader. When the applicator is used to spread cream in a crevice, the tip retains any excess cream behind it, and the wings bend back and evenly spread the cream along the sides of the crevice. The wings have side bevels that remove any sharp edges on the wings.

23 Claims, 16 Drawing Sheets

SECTION A-A

APPLICATOR

CROSS REFERENCE TO RELATED APPLICATIONS

This utility patent application is a continuation of, and claims priority back to, U.S. Utility application Ser. No. 16/177,783, filed 1 Nov. 2018, entitled "Applicator", the contents of which are incorporated by reference into this application.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of devices used to apply viscous liquids to a surface, and more specifically, to an applicator that can apply creams and other like items to non-planar surfaces, including human surfaces such as a baby's bottom, where a delicate but effective spreading is desirable.

Brief Description of Invention

The invention is an applicator that can be either sold with a tube of cream, or sold by itself and retrofitted onto an existing tube of cream. The applicator has an elongated hole that connects the tube of cream with a spreader, which evenly distributes the cream. The spreader has wings and a tip that protrude horizontally from the end of the hole, and the wings and tip and flexible, such that as cream is pushed through the hole and the spreader is pushed toward a surface to be covered, the wings and tip spread the cream to create a smooth and even surface. The wings also have wing bevels that remove any sharp edges from the wings, such that the invention can be comfortably used on humans. The flexible applicator material that comprises the wings is, preferably, manufactured with an antimicrobial additive which actively challenges harmful mold and bacteria. A preferred embodiment of this invention is for use in applying cream to the bottom of a baby, but the invention is applicable to evenly spreading cream onto any non-planar surface. The invention works particularly well when trying to apply a cream to a crevice, where the wings bend out of the way during application to evenly spread the cream as the tube is moved "down" the crevice.

Prior Art

The prior art has several examples of attempts to resolve this problem, but none provide an applicator capable of comfortably spreading cream on a non-planar surface, such as a baby's bottom, in an effective manner. For example, published patent application US 20150024131 A1 to Evans teaches an applicator tip that would be comfortably spread cream on a non-planar surface. The shape of the tip (170 in FIG. 3) would provide a successful spread on a flat surface, but not on a non-planar surface. U.S. Pat. No. 7,338,227 B2 to Bullivant teaches a roll-up applicator which, as with the Evans '131 publication, would not function on a non-planar surface. U.S. Pat. No. 6,536,970 B2 to Hauser, et. al. also provides an applicator that would not comfortably spread a cream on a non-planar surface.

The prior art also provides a number of other inventions, such as US20140186092A1 to Carefusion 2200, Inc., U.S. Pat. No. 7,210,870 B2 to Cosmetic Concepts, Inc., U.S. Pat. No. 3,236,417 A to Onthauk, U.S. Pat. No. 2,584,735 A to Pancoast, U.S. Pat. No. 7,325,994 B2 to Liberatore, U.S. Pat. No. 5,638,990 A to Kastberg, and U.S. Pat. No. 2,197,579 A to Hooper, which teach a spreading device, but one which works best with planar surfaces and would be inefficient to use on a curved, or crevice-like surface such as that of a baby's bottom.

Thus, based upon the attempts in the prior art and the resulting failure to find an efficient and effective applicator, there has existed a long-felt need for an applicator that effectively spreads a cream on non-planar surfaces. There is a particularly felt need for an applicator that can safely and efficiently spread cream in on a baby's bottom.

The current invention provides just such a solution by having an applicator that fits securely over a tube of cream or other viscous substance, with a delivery channel between the tube of cream and a spreader, which spreads the cream evenly and safely such that the invention can be used with humans, and, particularly, babies. The applicator has a base unit that fits over the opening in the tube of cream and directs the cream through a hole in applicator unit, which is the upper part of the invention. The applicator unit has a spreader, which evenly distributes the cream onto a non-planar surface. The spreader is made from flexible, resilient material, and has a tip and wings that emanate out from the hole in the top of the spreader. When the applicator is used to spread cream in a crevice, the tip retains any excess cream behind it, and the wings bend back and evenly spread the cream along the sides of the crevice. The wings have side bevels the remove any sharp edges on the wings such that the applicator can be used for a preferred purpose of applying cream to a baby's bottom.

OBJECTS OF THE INVENTION

It is therefore an object of the present invention to provide an effective product for spreading a cream-like substance evenly on a non-planar surface.

An additional object of the invention includes providing an applicator that can effectively spread a cream-like substance into a crevice-like structure.

Another object of the invention is to provide an applicator with flexible wings and a tip that can be used to safely spread a cream upon the crevice in a baby's bottom.

Another object of the invention is to provide an applicator where the contact surface of the applicator is manufactured with an antimicrobial additive which actively challenges harmful mold and bacteria.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

REFERENCE NUMBERS USED

Figure 1:
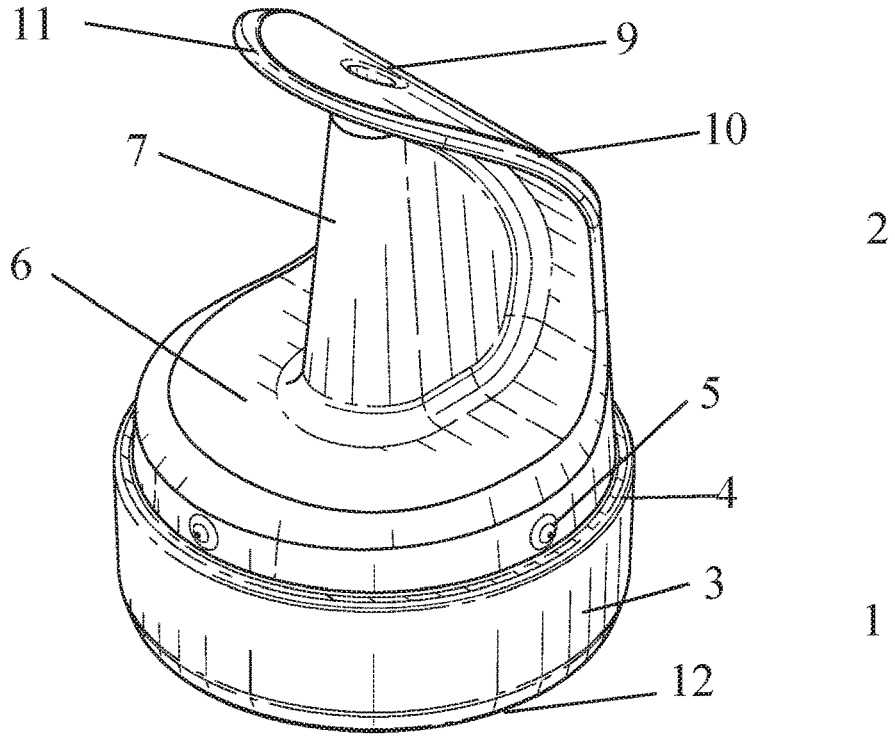
FIG. 1 is a top, back perspective view of a first embodiment of the invention.

1. Base generally
2. Applicator generally
3. Base
4. Top berm
5. Catch
6. Flat base
7. Stem
8. Spreader generally
9. Hole
10. Wings
11. Tip
12. Bottom berm
13. Threads
14. Hole support
15. Wing bevel
16. Cap
17. Cap thread
18. Tube
19. Rib
20. Tube of Cream
21. Non-planar surface
22. Top part
23. Bottom part
24. Bottom part ledge
25. Top part lip
26. Plug Bevel
27. Plug

DETAILED DESCRIPTION OF THE FIGURES

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Figure 25:
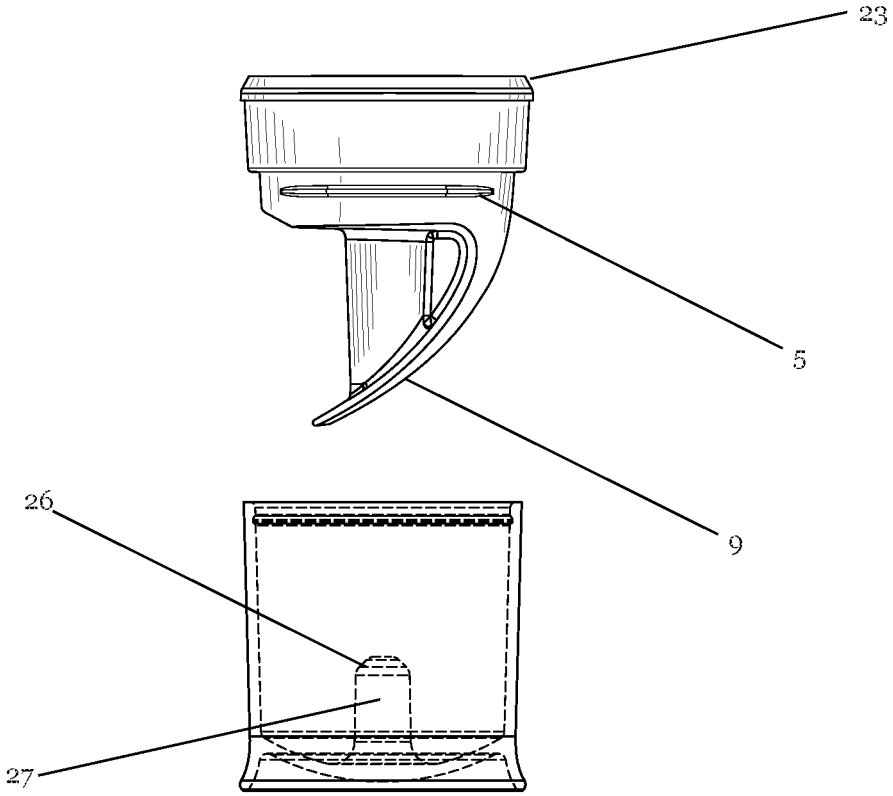
FIG. 25 is a side and cross-sectional view showing part 26, the "plug bevel" and part 27, the "plug".

FIG. 1 is a top, front perspective view of a first embodiment of the invention. The invention comprises two basic parts: a base (generally referenced as 1) and an applicator (generally referenced as 2). The base part has a base 3, with a top berm 4 and a bottom berm 12. The base 3 has an inner diameter designed to mate with the top of a variety of popular creams and other viscous liquids. The applicator part 2, extends vertically from the base part 1. Above the base 3 are catches 5, which will removably attach a cap (not shown in this figure) by clicking over cap threads (also not shown in this figure) on the inside of the cap. The cap has an internal feature that acts as a plug to prevent leakage, as illustrated in FIG. 25. Above the catches 5 is a flat base from which the spreader (generally referenced as 8) extends vertically. There is a stem 7 through which a hole 9 carries cream of the cream container (not shown in this figure) to the object upon which the cream is to be spread. Forming in a "swept" fashion over the stem 7 it a tip 11 and two wings 12. At the edges of the wings 12 is a wing bevel.

The invention is made from a soft but resilient plastic or other similar material. The flexible portion—basically the spreader 8 section of the invention—can be made from thermoplastic elastomer (TPE), thermoplastic polyurethane (TPU), or liquid silicone rubber (LSR). The cap, better illustrated in FIG. 25, is preferably made from polypropylene (PP). The retainment features (snap OR screw-on threads) on the bottom of the applicator will be rigid plastic in polypropylene (PP).

The goal of the spreader 8 part of the invention is to optimize performance of the applicator by manufacturing it out of two materials. This allows the two versions of the applicators, snap-on & screw-on, to have the appropriate amount of softness for human contact (preferably TPE), while being able to securely fasten to the squeeze bottles with rigid plastic (PP). The invention contemplates two possible means of manufacturing the applicator: 1. mold plastic insert out of PP that has the snap-on or screw-on features, then insert that plastic part into a second mold, which then injects the flexible TPE on top. The result is an applicator that is as soft as we need, yet hard where it interfaces with the squeeze bottle to prevent inadvertent dislodging while in use. An alternative method of manufacture would be to manufacture the entire unit out of a single material. While this would decrease the efficiency of the invention, it would cut costs, so making this invention from a single material is clearly contemplated by this invention.

To use the invention, a user either screws or snaps on the invention to the tube of cream (or buys a tube of cream with the applicator already attached and sold as part of the tube of cream). When the user of the invention squeezes the tube of cream, cream is expelled through the hole 9. The spreader, generally referenced as 8, then applies the cream evenly and safely to a surface. The wings 10 of the spreader and resilient and yet flexible so that they conform to a non-planar surface with a minimal amount of pressure and when the cream is to be spread on a non-planar surface, such as a corner of a shower stall or a baby's bottom, the wings 10 gently distributes the cream evenly into the crevice.

To enable hygienic use, the TPE material that the flexible material is made from is formulated with an antimicrobial additive during the manufacturing process. This additive contains a compound that actively challenges harmful bacteria and yeast that cause diaper rash and yeast infections. Since the antimicrobial additive is mixed throughout the flexible TPE material, the germ and mold-fighting properties are effective on the surface and within the material itself.

The tip 11 of the spreader serves to limit the amount of cream that can be distributed into a crevice, and redistributes any excess cream such that the invention leaves a uniform trail of cream. At the edges of the wings 10 are wing bevels 15 that provide a more gentle transition from the wings 10 to the surface upon which the cream is to be spread. This is useful in cases such as where a user of the invention is spreading caulking into the corner where the shower wall meets the floor, as the wing bevels 15 will provide a final "touch" of softness to the application. The wing bevels 15 are even more useful when using cream on a baby's bottom, where any sharp or rough edges of the applicator may result in a very unhappy baby.

Figure 2:
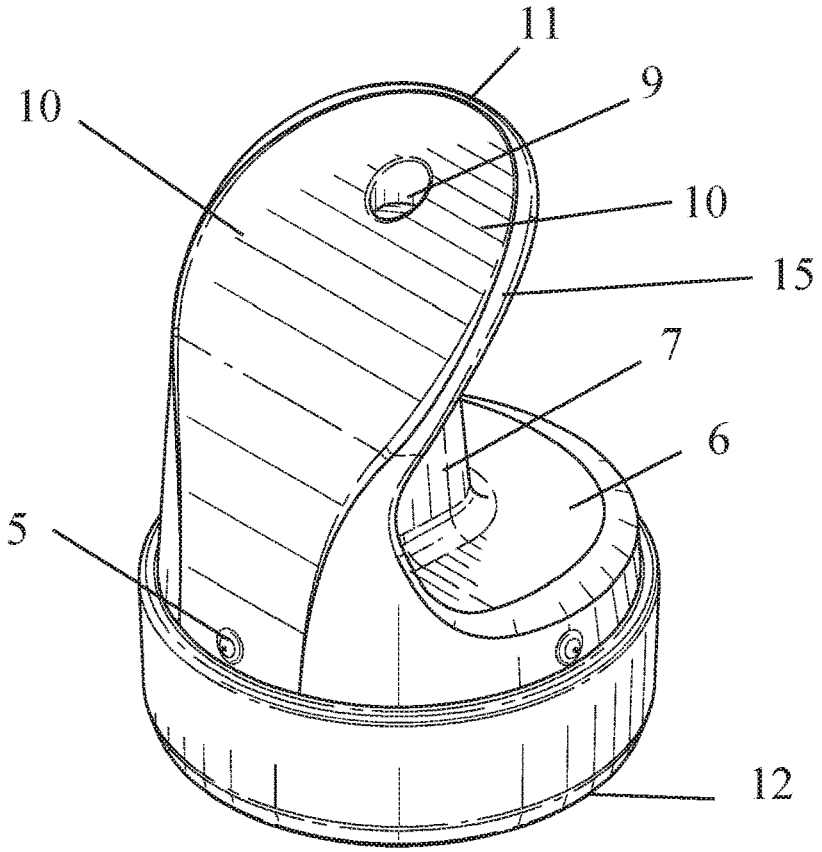
FIG. 2 is a top, back perspective view of a first embodiment of the invention.

FIG. 2 is a top, back perspective view of a first embodiment of the invention. This view shows how the tip 11 and wings 10 of the spreader serve to evenly distribute the cream that is expelled through the hole 9. This illustration also shows how the wing bevels 15 soften the edge of the wings 10, to not only create a more even spread of the cream, but also to present a soft profile should the invention be used on a human.

As the user of the invention presses the applicator against a non-planar surface, the flexible wings 10 bend away such that the profile presented by the applicator approaches a "V". The cream is emitted from hole 9 and the tip 11 keeps the cream semi-restrained in the crevice in which is directed. The wings 10 then spread the cream evenly, and the wing bevels 15 provide a soft, but finishing touch to the spreading of the cream. It should be noted that wings are wider in between the tip 11 and flat base 6. This allows for their flexibility in evenly spreading the cream on a curved or crevice-like surface, as the wings 10 can reach further into a crevice-like surfaces.

The stem 7 is also made from a flexible yet resilient material, such that it retains most of its physical structure. However, in the event of a mistake on the part of the user of the invention during which he/she puts too much pressure on the applicator, the stem 7 can bend, upon which the tip 11 and wings 10 will "fold" down toward the flat base 6.

Figure 3:
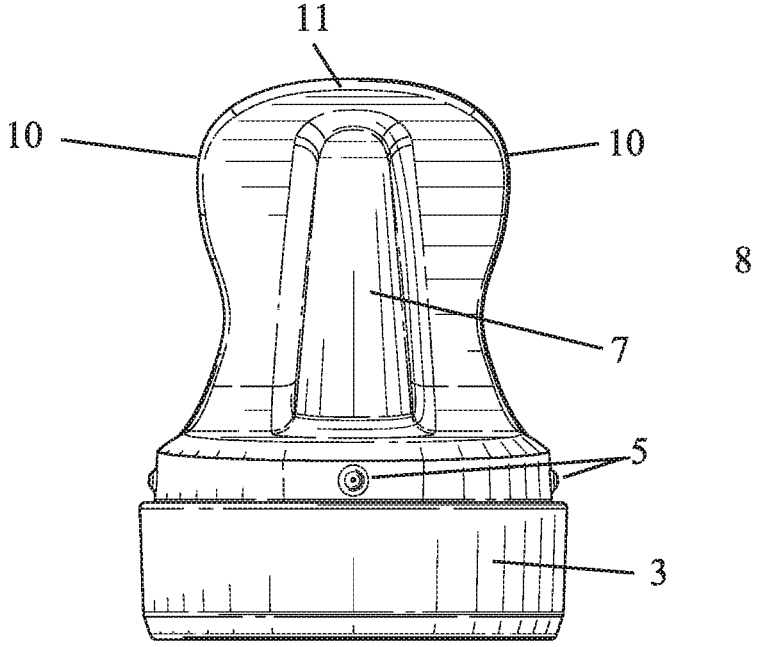
FIG. 3 is a front view of a first embodiment of the invention.

FIG. 3 is a front view of a first embodiment of the invention. Stem 7 provides the support for the spreader, which catches 5 can removably attach a cap (not shown in this figure).

Figure 4:
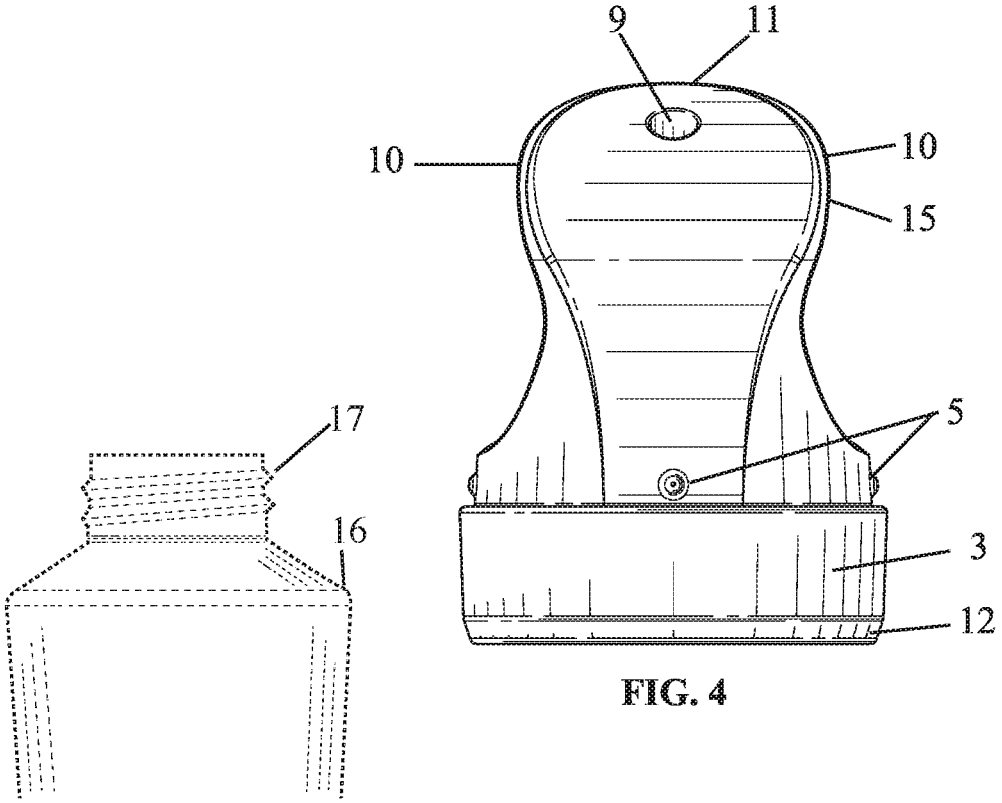
FIG. 4 is a back view of a first embodiment of the invention.

FIG. 4 is a back view of a first embodiment of the invention. Tip 11 and wings 10 extend laterally away from hole 9. The stem (reference number 7 in other figures) supports tip 11 and wings 10. Near the base 3 are catches 5, over which cap threads (not shown in this figure) can snap over.

Figure 5:
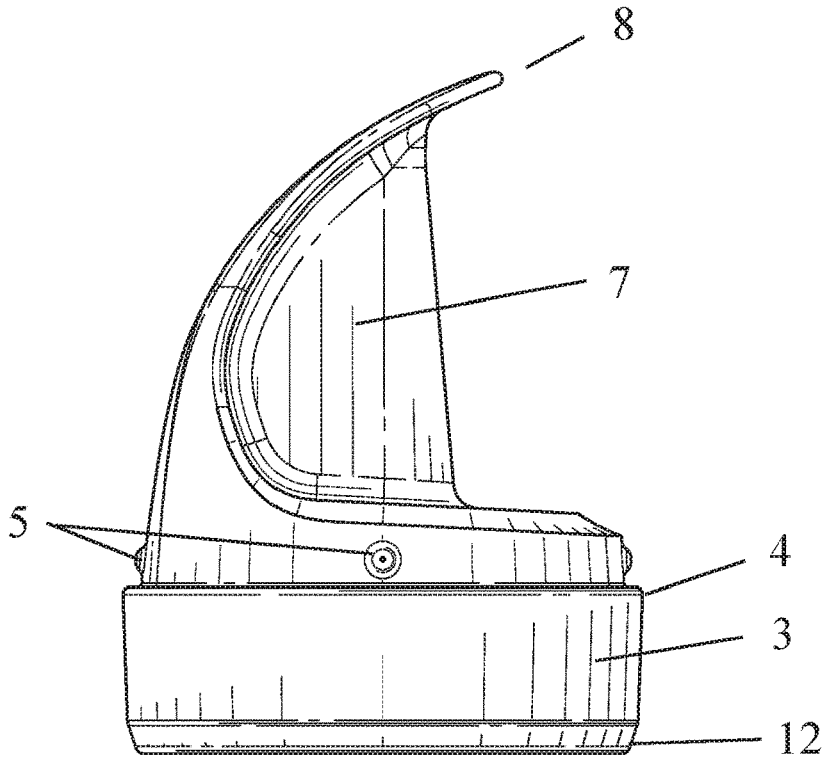
FIG. 5 is a left-side view of a first embodiment of the invention.

FIG. 5 is a left-side view of a first embodiment of the invention. In this first embodiment, stem 7 has two parallel sides, and narrows slightly from its connection to the rest of the spreader (8, generally) to its front-most portion. Stem 7 supports spreader 8.

Figure 6:
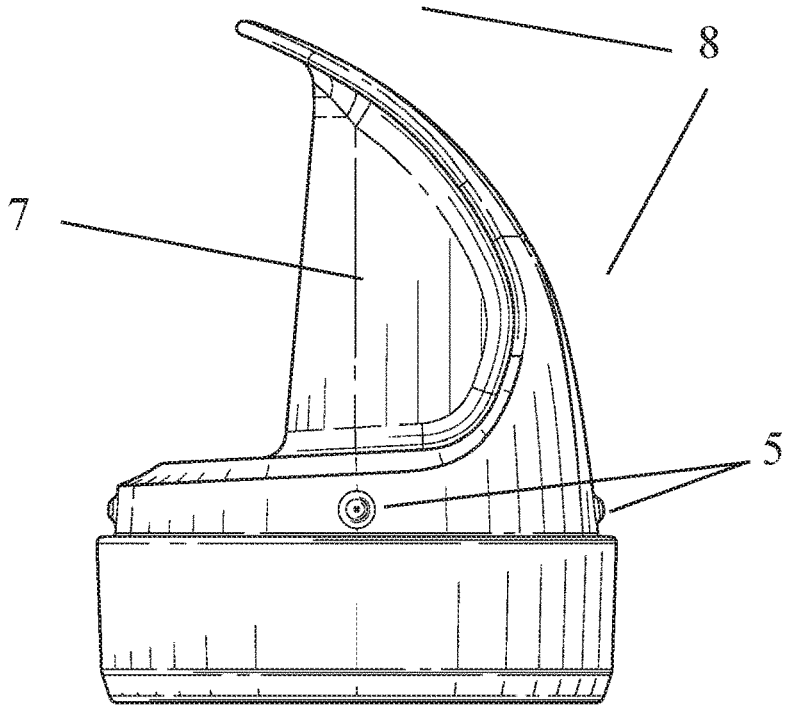
FIG. 6 is a right-side view of a first embodiment of the invention.

FIG. 6 is a right-side view of a first embodiment of the invention.

Figure 7:
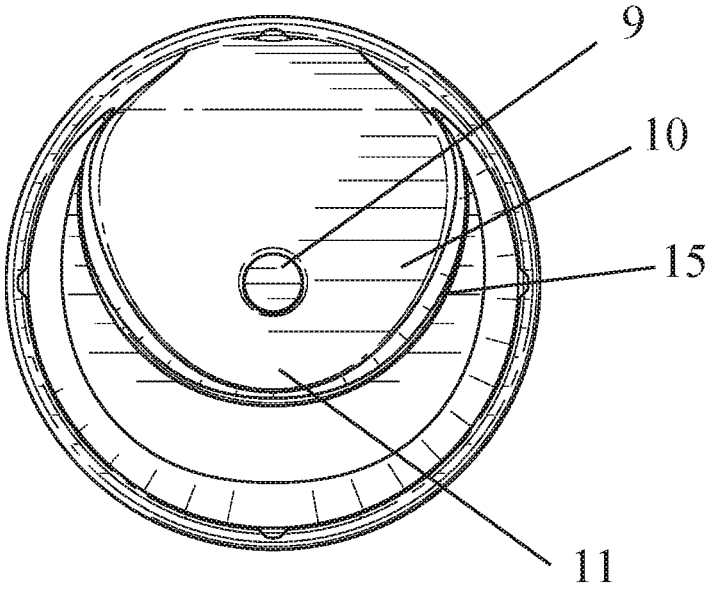
FIG. 7 is a top view of a first embodiment of the invention.

FIG. 7 is a top view of a first embodiment of the invention. Hole 9 is surrounded by tip 11 and wings 10. This figure illustrates that when a cream is expelled from hole 9, the device is angled against the surface such that tip 11 prevents excess cream from being lost as the applicator is moved along the surface. Wings 10 and wing bevels 15 serve to spread the cream evenly, and in the case where the invention is used to spread the cream on a delicate surface such as a baby's bottom, do so sensitively, with undue discomfort to the baby.

Figure 8:
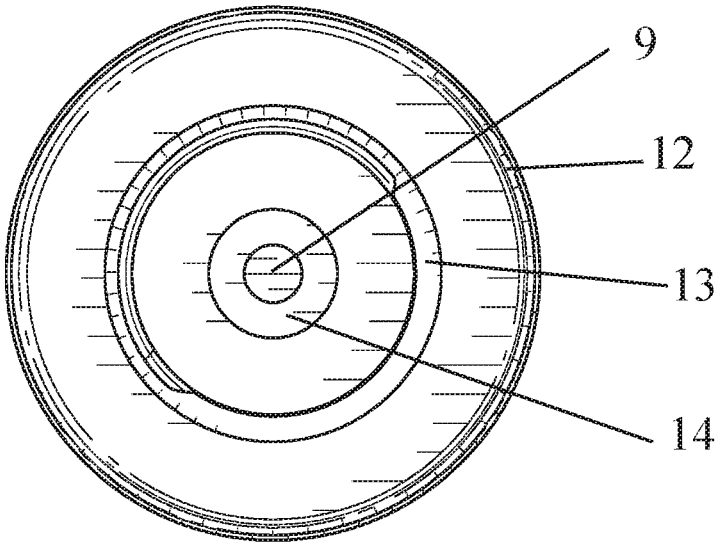
FIG. 8 is a bottom view of a first embodiment of the invention.

FIG. 8 is a bottom view of a first embodiment of the invention. Hole 9 is surrounded by hole support 14, which is a hollow, cylindrical portion of the invention that creates a delivery channel (the hole, 9) from the tube of the cream to the end, desired location. Surround the hold support 14 are threads 13 that removably secure the applicator to a tube of cream. The bottom berm 12 softens the edge of the base portion of the applicator, providing a softened edge that will be more attractive to a consumer as well as protecting their hands when installing and removing the applicator.

Figure 9:
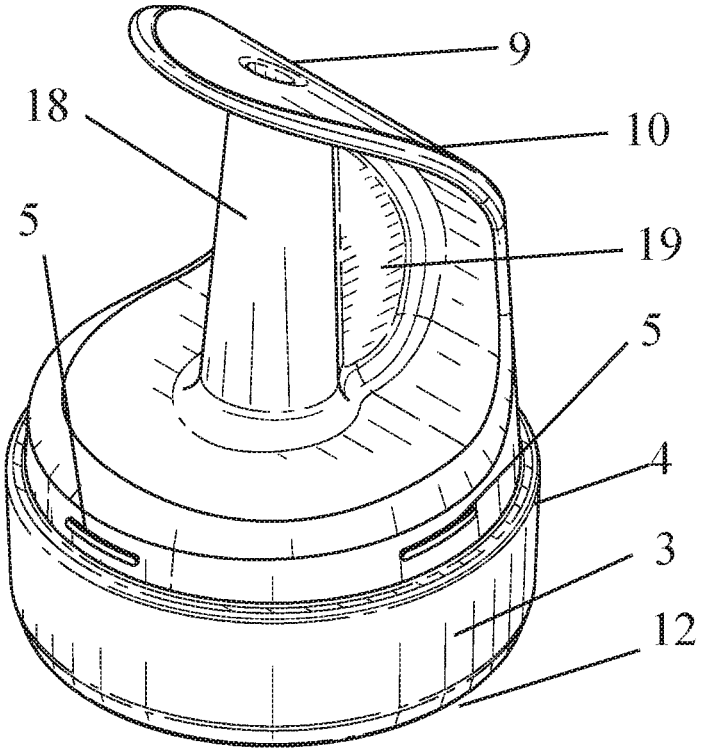
FIG. 9 is a top, front perspective view of a second embodiment of the invention.

FIG. 9 is a top, front perspective view of a second embodiment of the invention.

Figure 10:
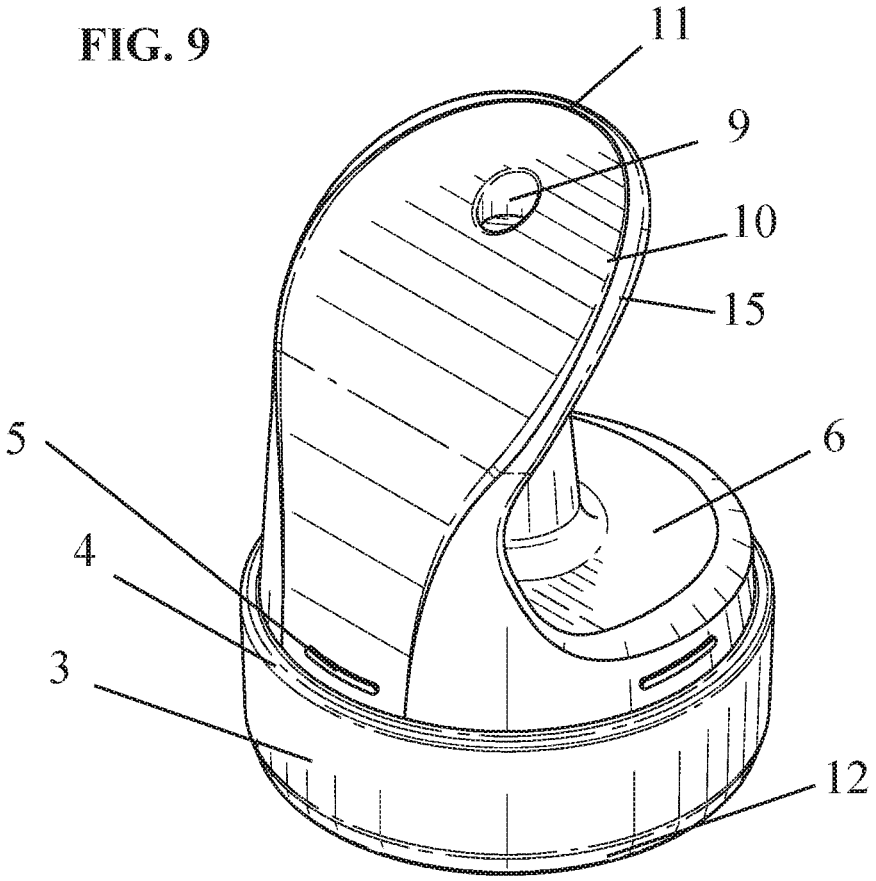
FIG. 10 is a top, back perspective view of a second embodiment of the invention.

FIG. 10 is a top, back perspective view of a second embodiment of the invention. There are two main design differences in this embodiment of the invention. First, the catches 5 are elongated ridges rather than the dots seen in the first embodiment. Second, the stem (7 in the first embodiment) is not of relatively uniform thickness, but rather has a roughly cylindrical portion, the tube 18, which creates the hole 9, and a rib section 19, that is a thin connection between the spreader and the tube 18. This second embodiment has significant advantages over the first embodiment. First, it facilitates even flow during injection molding to the tip of the spreader such that a stronger final product is produced with fewer irregularities. Second, it blocks cream from entering between the spreader and the tube for ease of cleaning. Third, it is strategically creating rigidity at the center of the spreader so that the center of the spreader always remains in contact with the skin, even when the wings conform to adjacent surfaces. This is particularly useful when used on an irregular/undulating skin surface like the crevice of a baby's bottom.

Figure 11:
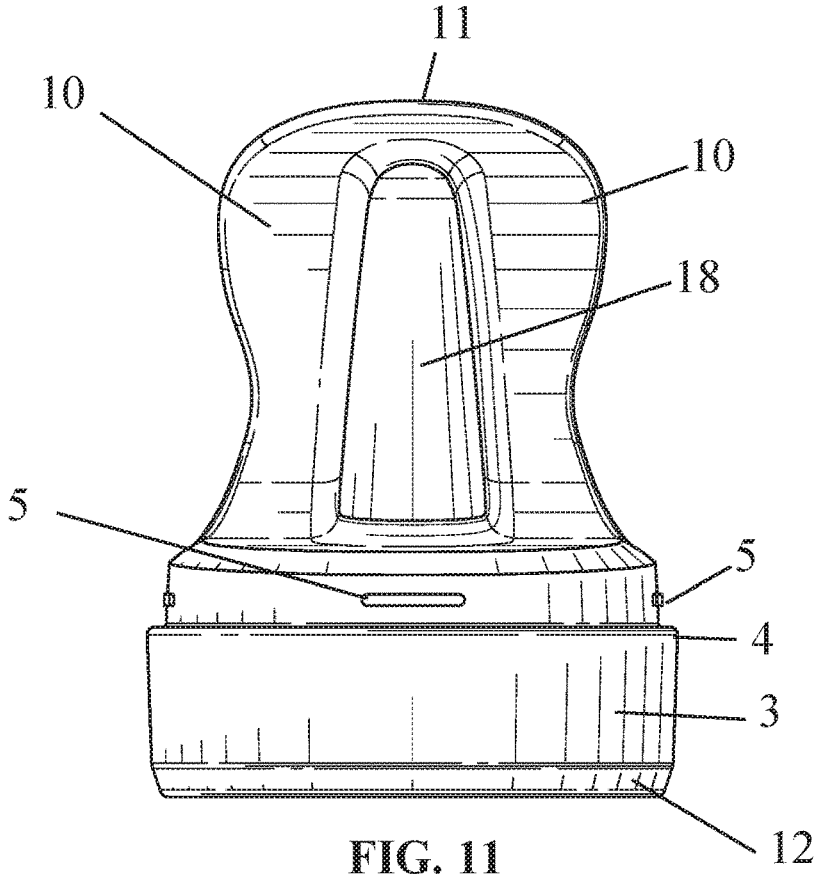
FIG. 11 is a front view of a second embodiment of the invention.

FIG. 11 is a front view of a second embodiment of the invention.

Figure 12:
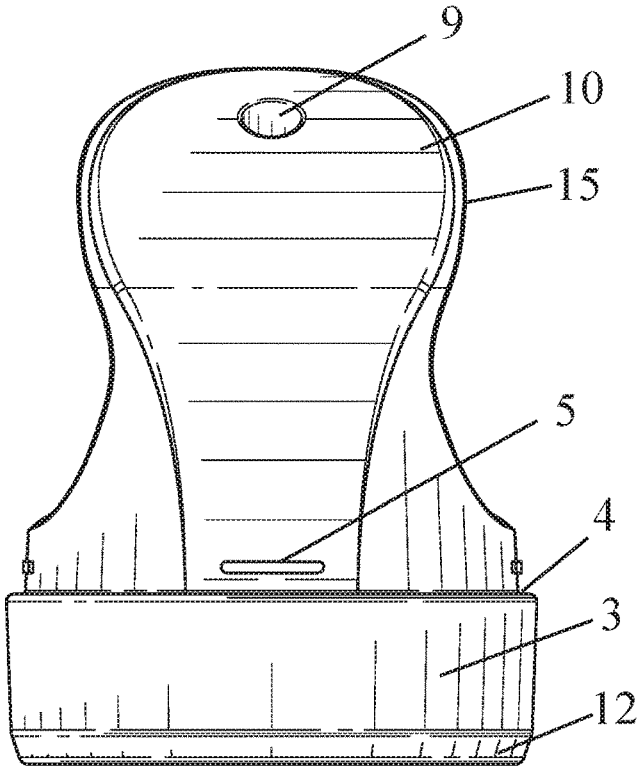
FIG. 12 is a back view of a second embodiment of the invention.

FIG. 12 is a back view of a second embodiment of the invention.

Figure 13:
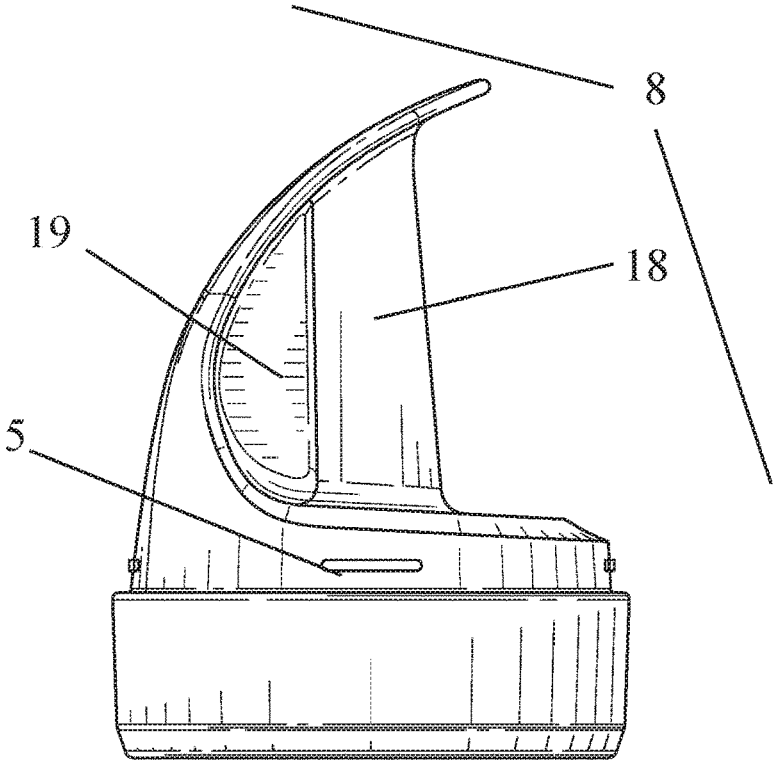
FIG. 13 is a left-side view of a second embodiment of the invention.

FIG. 13 is a left-side view of a second embodiment of the invention.

Figure 14:
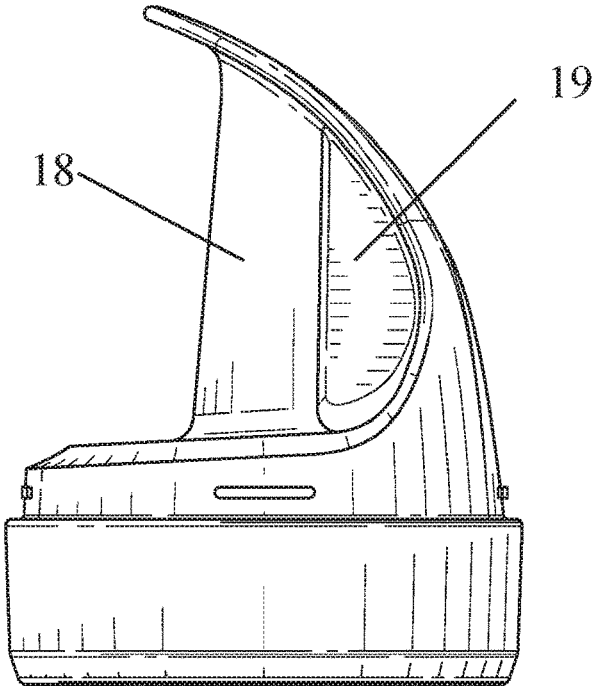
FIG. 14 is a right-side view of a second embodiment of the invention.

FIG. 14 is a right-side view of a second embodiment of the invention.

Figure 15:
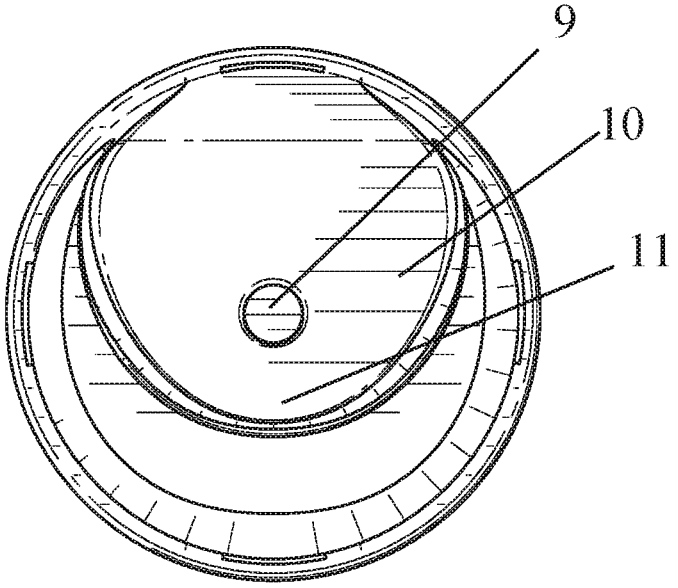
FIG. 15 is a top view of a second embodiment of the invention.

FIG. 15 is a top view of a second embodiment of the invention.

Figure 16:
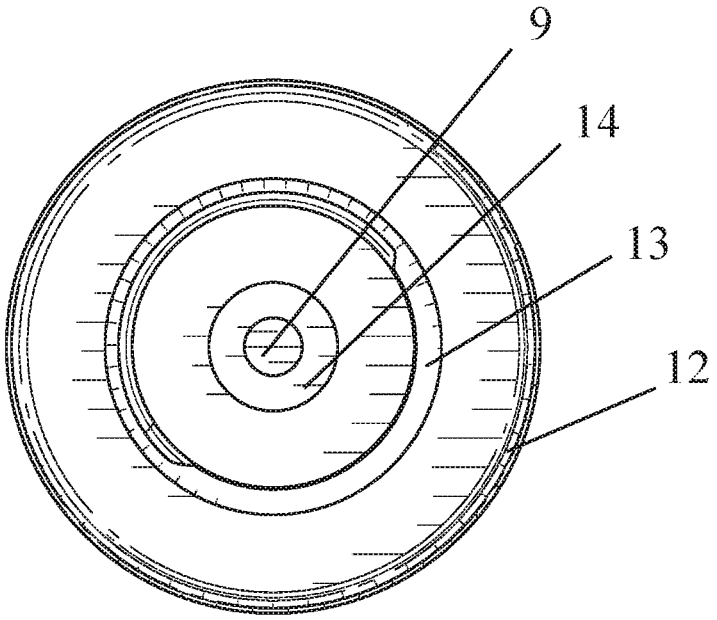
FIG. 16 is a bottom view of a second embodiment of the invention.

FIG. 16 is a bottom view of a second embodiment of the invention.

Figure 17:
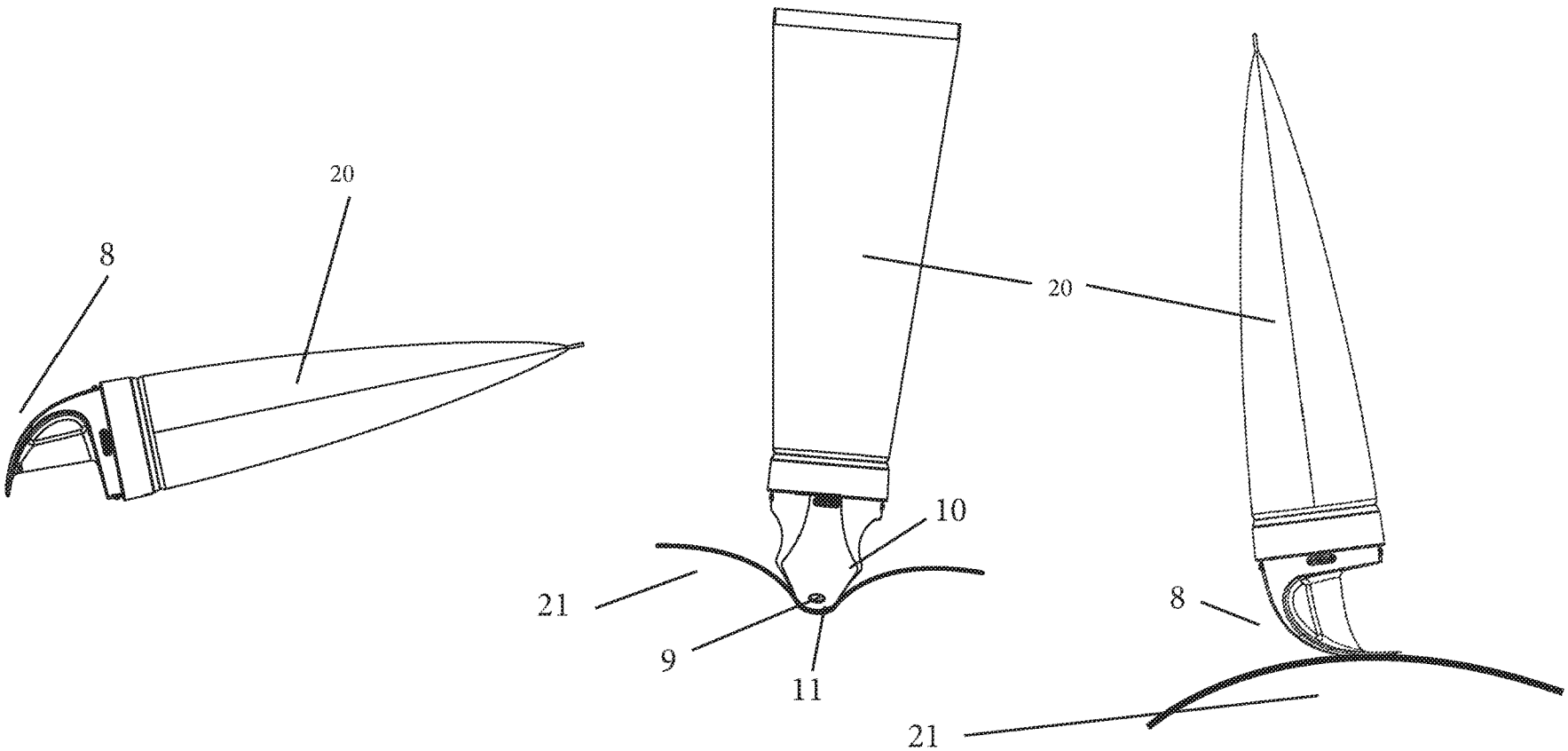
FIG. 17 is a series of perspective views of the invention being used to apply a cream to a non-planar surface.

FIG. 17 is a series of perspective views of the invention being used to apply a cream to a non-planar surface. As the tube 20 is squeezed, cream is expelled from hole 9. Tip 11 forces the cream to the sides, and wings 10 spread the cream evenly. The non-planar surface 21 here is a baby's bottom. Stem 7 provides support for hole 9, wings 10 and tip 11.

Figure 18:
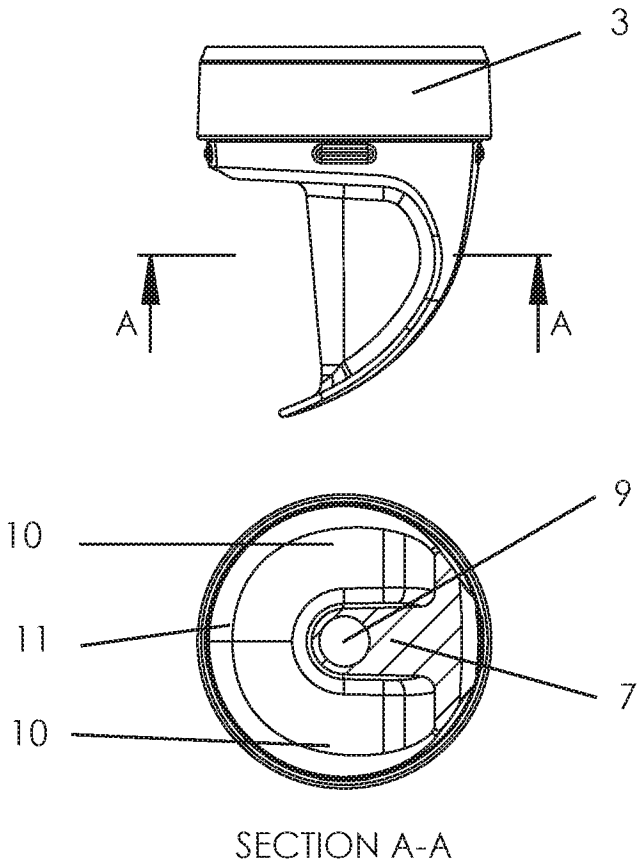
FIG. 18 is side view and a cross sectional view of one embodiment of the invention.

FIG. 18 is side view and a cross sectional view of one embodiment of the invention. The cream is expelled from hole 9. Tip 11 forces the cream to the sides, and wings 10 spread the cream evenly. Stem 7 provides support for hole 9, wings 10 and tip 11.

Figure 19:
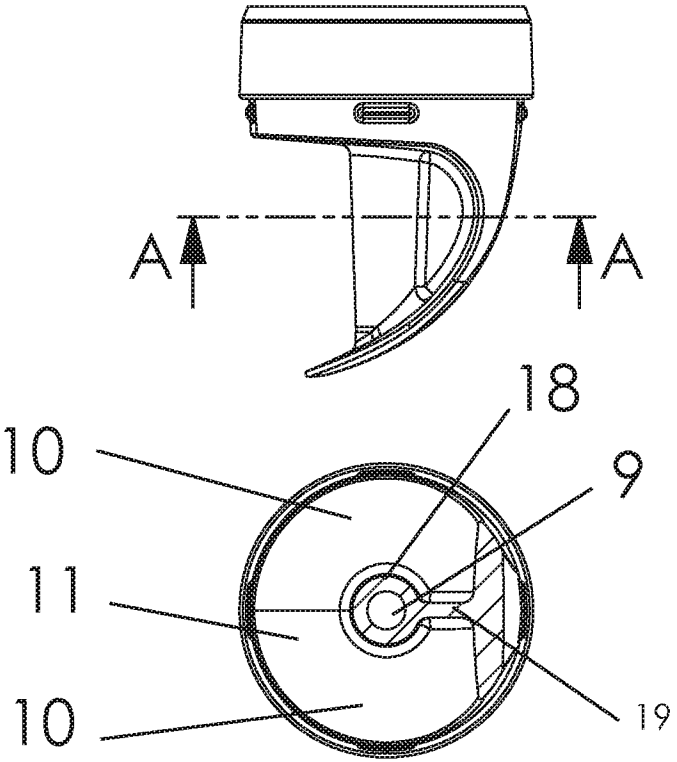
FIG. 19 is a side view and a cross sectional view of a second embodiment of the invention.

FIG. 19 is a side view and a cross sectional view of a second embodiment of the invention. The cream is expelled from hole 9. Tip 11 forces the cream to the sides, and wings 10 spread the cream evenly. Tube 18 creates hole 9, and is supported by rib 19.

Figure 20:
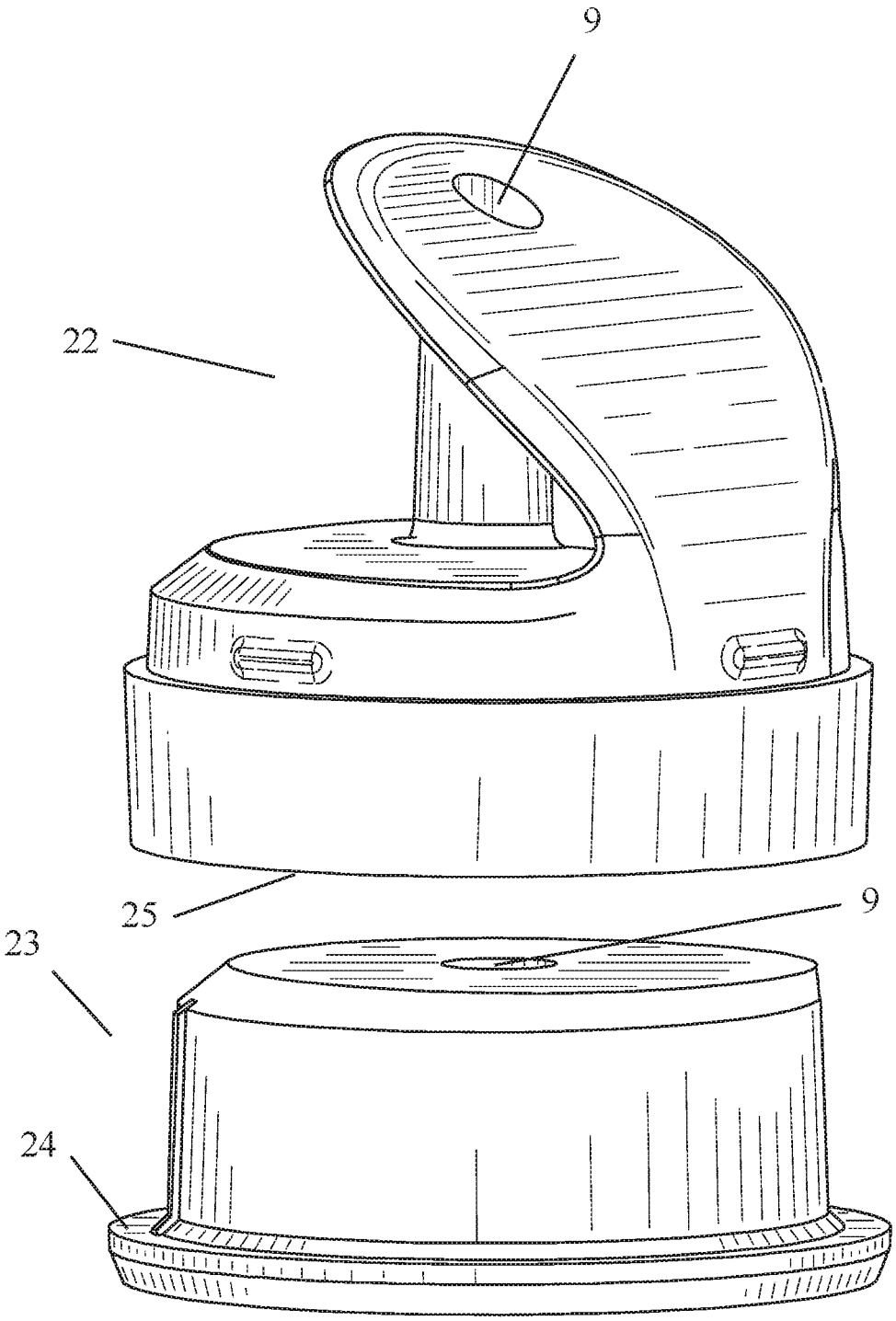
FIG. 20 is a side, perspective view of a two-part, overmold version of the invention.

FIG. 20 is a side, perspective view of a two-part, over-mold version of the invention. There is a top part 22 and a bottom part 23. The hole 9 goes through both parts. The top part lip 25 rests on the bottom part ledge 24. It is contemplated that the two parts could be made from different materials, or the same material.

Figure 21:
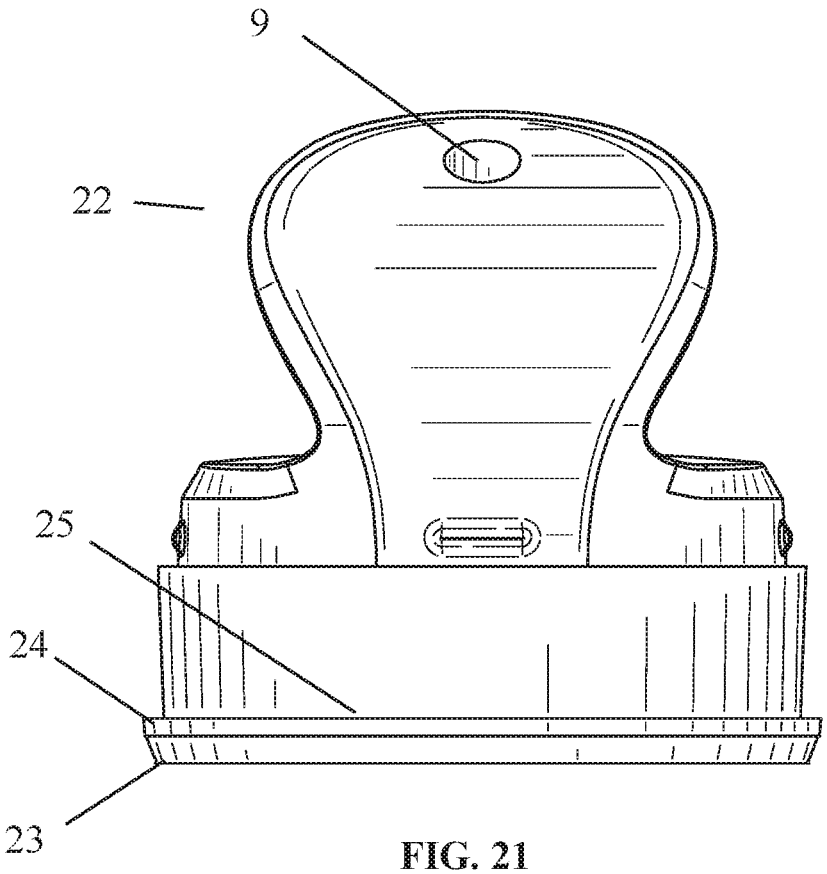
FIG. 21 is a back view of the version shown in FIG. 20.

FIG. 21 is a back view of the version shown in FIG. 20.

Figure 22:
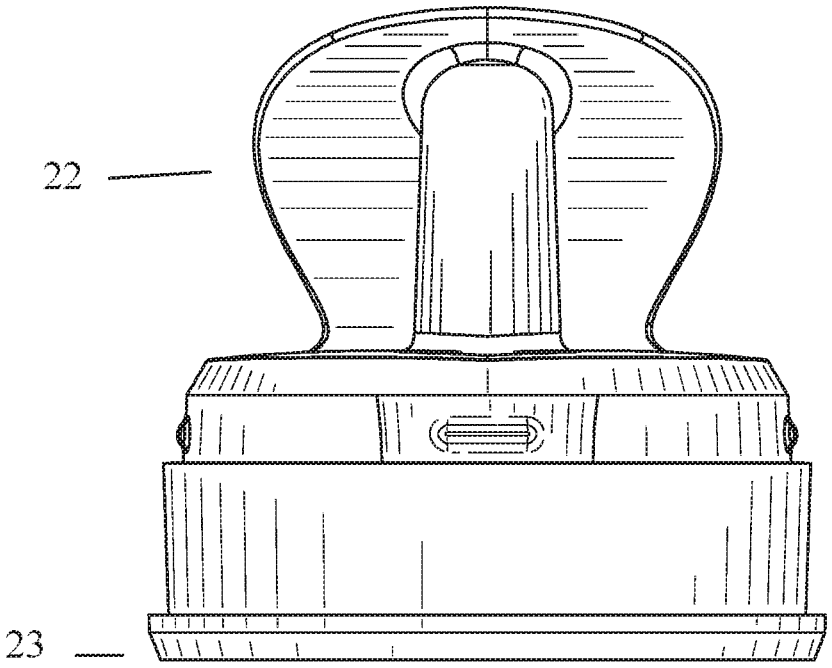
FIG. 22 is a front view of the version shown in FIG. 20.

FIG. 22 is a front view of the version shown in FIG. 20.

Figure 23:
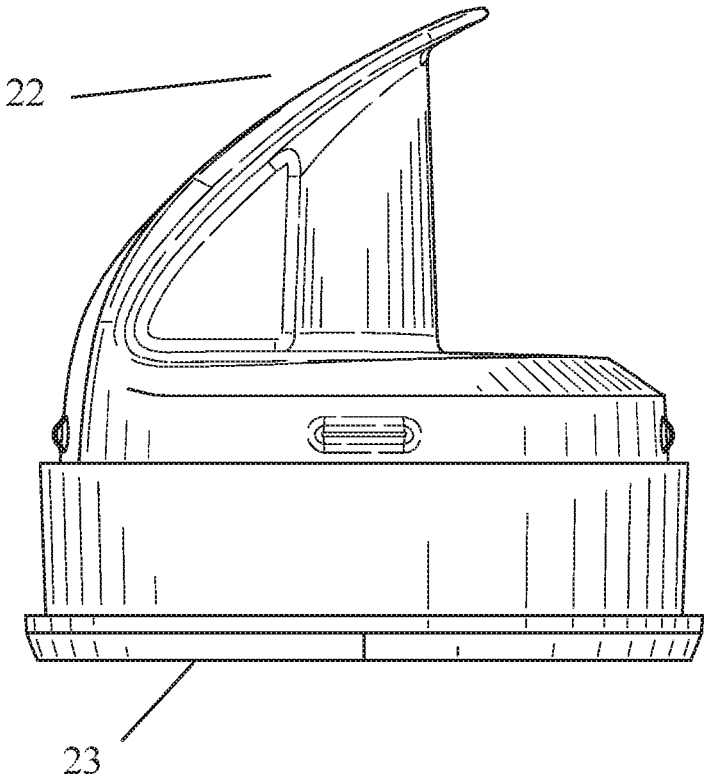
FIG. 23 is a left-side view of the version shown in FIG. 20.

FIG. 23 is a left-side view of the version shown in FIG. 20.

Figure 24:
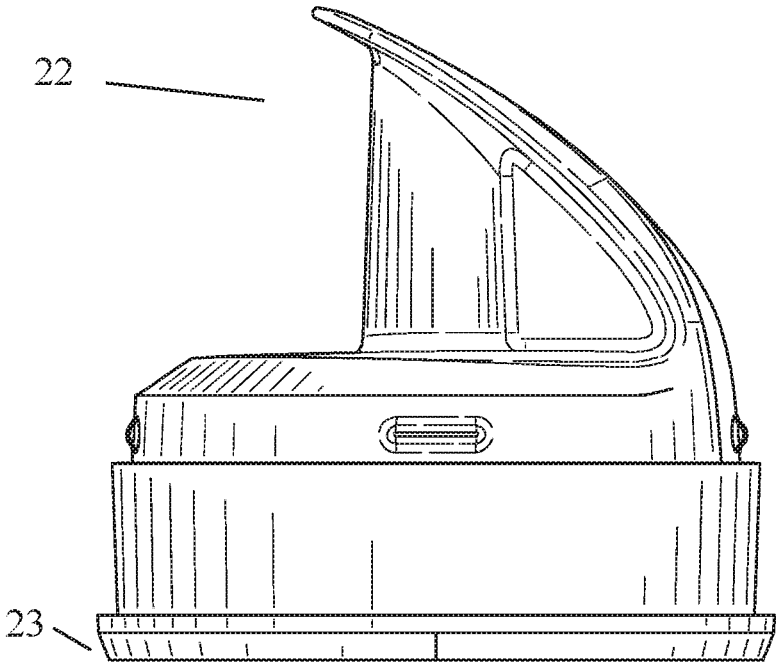
FIG. 24 is a right-side view of the version shown in FIG. 20.

FIG. 24 is a right-side view of the version shown in FIG. 20.

FIG. 25 is a side and cross-sectional view of the applicator and its cap. The hole 9 in the applicator nestles over a plug 27. A plug bevel 26 provides a telescoped surface which guides plug 27 into hole 9.

Figure 26:
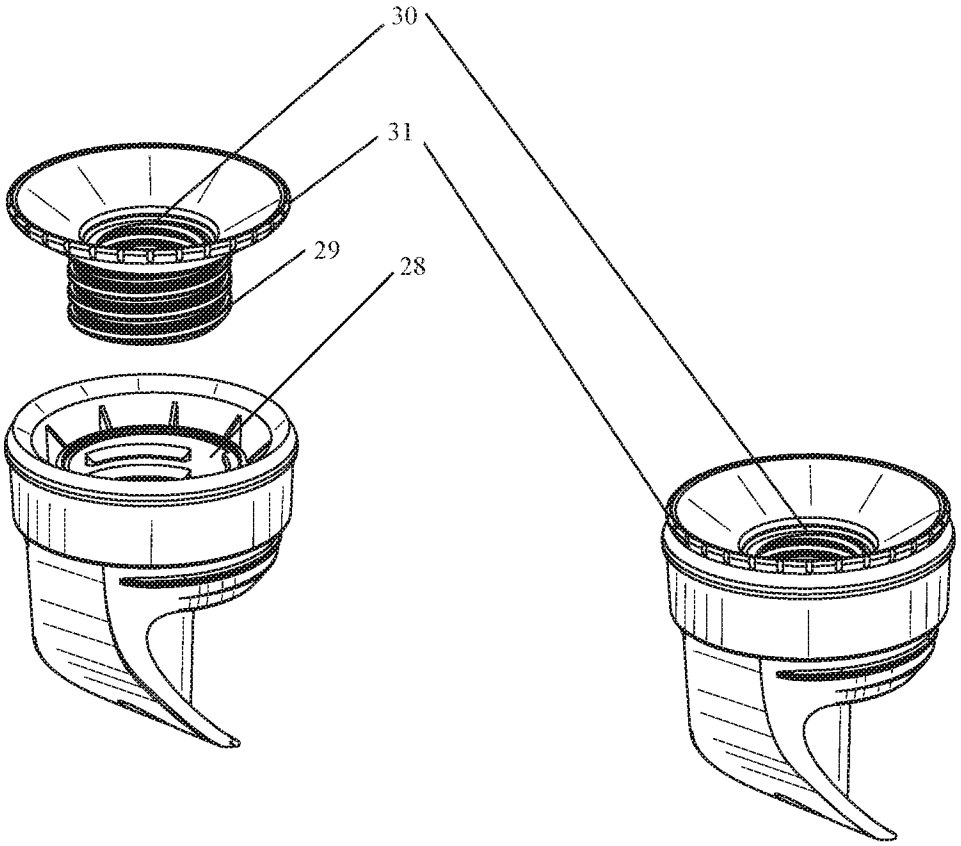
FIG. 26 is a perspective view of one embodiment of the invention.

FIG. 26 is a perspective view of one embodiment of the invention. An adaptor 31 has adaptor male threads 29 that mate with cap female threads 28, allowing a tube with a different diameter that will mate with the adaptor female threads 30, allowing the invention to be used with tubes with different outlet dimeters.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention. Indeed, it should be particularly noted that two-shot over-molding, as well as single material molding is contemplated.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What I claim is:

1. An Applicator, comprising a base unit and an applicator unit, where the base unit additionally comprises a base, where the base has a base side, a base bottom and a base top and where the base bottom contains two or more threads, where the two or more threads mate with a set of matching threads from a tube of a viscous liquid, and when a user squeezes the tube of viscous liquid, a quantity of the viscous liquid enters the base, and where the base contains the viscous liquid from the tube to the applicator unit, where the applicator unit additionally comprises a spreader and a hole, where the hole is an opening that connects the base to an exterior of the applicator, where the base unit comprises a first set of threads with a first thread diameter, and a second set of threads with a second thread diameter, where the first thread diameter is not equal to the second thread diameter.

2. The Applicator of claim 1, where the first set of threads mate with a first tube set of threads from a first tube diameter, and the second set of threads mate with a second tube set of threads from a second tube diameter.

3. The Applicator of claim 2, where the first tube set of threads are from a first tube, and where the second tube set of threads are from a second tube, and where both the first tube diameter and the second tube diameter are not equal, and where the first tube and the second tube both contain viscous liquid.

4. The Applicator of claim 1, where the spreader additionally comprises two wings, where the two wings are flexible and resilient, such that when the applicator is pressed into a non-planar surface, the two wings partially bend to allow for the even distribution of the viscous liquid.

5. The Applicator of claim 4, where each of the two wings additionally comprise a wing bevel, where the wing bevel comprises two sloped surfaces, a first sloped surface from a top of the wing, and a second sloped surface coming off a bottom of the wing, where each of the wing bevels provide a final smoothing of the viscous liquid, where the wing bevels provide a soft transition from the edge of each wing such that the applicator can be used on a baby or other human use.

6. The Applicator of claim 1, where the spreader has a spreader top, a spreader back side, and a spreader bottom portion, and where the spreader serves to spread the viscous liquid where the spreader additionally comprises a tip, where the tip projects outwardly and upwardly in front of the hole, and where the tip serves to retain a portion of the viscous liquid and redirect it to the wings.

7. The Applicator of claim 6, additionally comprising a stem, where the stem has in its center a cavity, where the cavity is the hole, where the stem extends from the base to the spreader where the spreader has a spreader top, a spreader back side, and a spreader bottom portion, and where the spreader serves to spread the viscous liquid.

8. The Applicator of claim 7, where the applicator additionally comprises an applicator top part and an applicator bottom part, where the applicator bottom part additionally comprises a bottom part ledge and the applicator top part additionally comprises a top part lip, where the bottom part ledge has a first diameter and the top part lip has a second diameter, and the first diameter is greater than the second diameter such that the top part lip rests upon the bottom part ledge, and where the spreader and the base are made from different materials, where the stem is a roughly circular object in cross section called a tube and extends from the base to the spreader and from the back side of the spreader to beyond the hole.

9. The Applicator of claim 1, where the spreader is made from thermoplastic elastomer (TPE), where the spreader has a spreader top, a spreader back side, and a spreader bottom portion, and where the spreader serves to spread the viscous liquid.

10. The Applicator of claim 1, where the spreader is made from liquid silicone rubber (LSR), where the spreader additionally comprises two wings, where the two wings are flexible and resilient, such that when the applicator is pressed into a non-planar surface, the two wings partially bend to allow for the even distribution of the viscous liquid where the base unit comprises a first set of threads with a first thread diameter, and a second set of threads with a second thread diameter, where the first thread diameter is not equal to the second thread diameter.

11. The Applicator of claim 10, where the base unit comprises the first set of threads with the first thread diameter, and the second set of threads with the second thread diameter, where the first thread diameter is not equal to the second thread diameter the first set of threads mate with the first tube set of threads from the first tube diameter, and the second set of threads mate with the second tube set of threads from the second tube diameter, where the first tube set of threads are from the first tube, and where the second tube set of threads are from the second tube, and where both the first tube diameter and the second tube diameter are not equal, and where the first tube and the second tube both contain viscous liquid, where the applicator additionally comprises an adaptor, where the adaptor has a plurality of adaptor outer threads, a plurality of adaptor inner threads, and an adaptor grip texture, where the adaptor allows the applicator to be attached to at least two different tubes where each of the at least two different tubes have different tube diameters.

12. The Applicator of claim 11, where the plurality of adaptor outside threads mate with the two or more threads from the base of the applicator, such that the user can attach the adaptor to the applicator, and where the plurality of adaptor inner threads mate with a top of a second container of viscous liquid where the second container of viscous liquid has an outlet with a second diameter, and the second diameter is different from the first diameter of the first tube of viscous liquid.

13. An Applicator system, comprising an applicator and a cap, where the applicator comprises a base unit and an applicator unit, where the base unit additionally comprises a base, where the base has a base side, a base bottom and a base top and where the base bottom contains two or more threads, where the two or more threads mate with a set of matching threads from a tube of a viscous liquid, and when a user squeezes the tube of viscous liquid, a quantity of the viscous liquid enters the base, and where the base contains the viscous liquid from the tube to the applicator unit, where the applicator unit additionally comprises a spreader and a hole, where the hole is an opening that connects the base to an exterior of the applicator, where the spreader additionally comprises two wings, where the two wings are flexible and resilient, such that when the applicator is pressed into a non-planar surface, the two wings partially bend to allow for the even distribution of the viscous liquid, where each of the two wings additionally comprise a wing bevel, where the wing bevel comprises two sloped surfaces, a first sloped surface from a top of the wing, and a second sloped surface coming off a bottom of the wing, where each of the wing bevels provide a final smoothing of the viscous liquid, where the wing bevels provide a soft transition from the edge of each wing such that the applicator can be used on a baby or other human use.

14. The Applicator of claim 13, where the spreader has the spreader top, the spreader back side, and the spreader bottom portion, and where the spreader serves to spread the viscous liquid, and where the cap comprises the cap bottom, the cap side portion, the plug and the plug bevel, where the cap side portion is the cylinder with the cylinder top and the cylinder bottom which is open at the top and bounded by the cap bottom at the cylinder bottom, where the plug extends from the cap bottom in a vertical direction, and where the plug bevel is the rounded object located at an upper part of the plug, and there the plug has the plug diameter, and where the hole has the hole diameter, and there the hole diameter is slightly larger than the plug diameter, such that the hole can be slid over the plug, thereby sealing the hole.

15. The Applicator of claim 13, where the spreader additionally comprises a tip, where the tip projects outwardly and upwardly in front of the hole, and where the tip serves to retain a portion of the viscous liquid and redirect it to the wings, where the applicator additionally comprises an applicator top part and an applicator bottom part, where the applicator bottom part additionally comprises a bottom part ledge and the applicator top part additionally comprises a top part lip, where the bottom part ledge has a first diameter and the top part lip has a second diameter, and the first diameter is greater than the second diameter such that the top part lip rests upon the bottom part ledge, and, where the spreader is made from a spreader material and the base is made from a base material, and the spreader material is different from the base material.

16. The Applicator of claim 15, additionally comprising the stem, where the stem has in its center the cavity, where the cavity is the hole, where the stem extends from the base to the spreader, where the base unit comprises the first set of threads with the first thread diameter, and the second set of threads with the second thread diameter, where the first thread diameter is not equal to the second thread diameter, and where the first set of threads mate with the first tube set of threads from a first tube diameter, and the second set of threads mate with the second tube set of threads from the second tube diameter.

17. An Applicator system, comprising an applicator and a cap, where the applicator comprises a base unit and an applicator unit, where the base unit additionally comprises a base, where the base has a base side, a base bottom and a base top and where the base bottom contains two or more threads, where the two or more threads mate with a set of matching threads from a tube of a viscous liquid, and when a user squeezes the tube of viscous liquid, a quantity of the viscous liquid enters the base, and where the base contains the viscous liquid from the tube to the applicator unit, where the applicator unit additionally comprises a spreader and a hole, where the hole is an opening that connects the base to an exterior of the applicator, where the spreader additionally comprises two wings, where each of the two wings additionally comprises a wing bevel, where each of the wing bevels provide a final smoothing of the viscous liquid, where the wing bevels provide a soft transition from the edge of each wing such that the applicator can be used on a baby or other human use.

18. The Applicator of claim 17, where the wing bevel comprises two sloped surfaces, a first sloped surface from the top of the wing, and the second sloped surface coming off a bottom of the wing.

19. The Applicator of claim 17, where the two wings are flexible and resilient, such that when the applicator is pressed into a non-planar surface, the two wings partially bend to allow for the even distribution of the viscous liquid.

20. The Applicator of claim 19, additionally comprising the stem, where the stem has in its center the cavity, where the cavity is the hole, where the stem extends from the base to the spreader.

21. The Applicator of claim 20, where the adaptor has the plurality of adaptor outer threads, the plurality of adaptor inner threads, and the adaptor grip texture, where the plurality of adaptor outside threads mate with the two or more threads from the base of the applicator, such that the user can attach the adaptor to the applicator, and where the plurality of adaptor inner threads mate with the top of the second container of viscous liquid where the second container of viscous liquid has an outlet with the second diameter, and the second diameter is different from the first diameter of the first tube of viscous liquid where the spreader is made from a material selected from the group comprising thermoplastic elastomer (TPE), thermoplastic polyurethane (TPU), and liquid silicone rubber (LSR).

22. The Applicator of claim 20, where the cap comprises a cap bottom, a cap side portion, a plug and a plug bevel, where the cap side portion is a cylinder with a cylinder top and a cylinder bottom which is open at the top and bounded by the cap bottom at the cylinder bottom, where the plug extends from the cap bottom in a vertical direction, and where the plug bevel is a rounded object located at an upper part of the plug, and there the plug has a plug diameter, and where the hole has a hole diameter, and there the hole diameter is slightly larger than the plug diameter, such that the hole can be slid over the plug, thereby sealing the hole, where the spreader additionally comprises two wings, where the two wings are flexible and resilient, such that when the applicator is pressed into a non-planar surface, the two wings partially bend to allow for the even distribution of the viscous liquid, where each of the two wings additionally comprise a wing bevel, where the wing bevel comprises two sloped surfaces, a first sloped surface from a top of the wing, and a second sloped surface coming off a bottom of the wing, where each of the wing bevels provide a final smoothing of the viscous liquid, where the wing bevels provide a soft transition from the edge of each wing such that the applicator can be used on a baby or other human use, where the applicator bottom part additionally comprises a bottom part ledge and the applicator top part additionally comprises a top part lip, where the bottom part ledge has a first diameter and the top part lip has a second diameter, and the first diameter is greater than the second diameter such that the top part lip rests upon the bottom part ledge, where the applicator additionally comprises a flat base, where the flat base is a relatively flat surface on top of the base.

23. The Applicator system of claim 17, where the base unit comprises the first set of threads with the first thread diameter, and the second set of threads with the second thread diameter, where the first thread diameter is not equal to the second thread diameter, and where the first set of threads mate with a first tube set of threads from the first tube diameter, and the second set of threads mate with the second tube set of threads from the second tube diameter.

* * * * *